United States Patent [19]

Walker et al.

[11] Patent Number: 4,936,215

[45] Date of Patent: Jun. 26, 1990

[54] PRINTING MACHINES

[75] Inventors: Norman Walker, Stockport; Peter J. Chadwick, Oldham, both of England

[73] Assignee: Cobden Chadwick Limited, Lancashire, England

[21] Appl. No.: 297,378

[22] Filed: Jan. 17, 1989

[30] Foreign Application Priority Data

Jan. 22, 1988 [GB] United Kingdom ..... 8801403

[51] Int. Cl.[5] ..... B41L 1/02

[52] U.S. Cl. ..... 101/486; 101/247

[58] Field of Search ..... 101/247, 248, 182, 183, 101/184, 185, 187, 485, 486, DIG. 36, DIG. 41, 137, 216, 218, 177, 135, 141

[56] References Cited

U.S. PATENT DOCUMENTS

| | | | |
|---|---|---|---|
| 3,800,698 | 4/1974 | Kist et al. | 101/247 |
| 4,108,067 | 8/1978 | Werner | 101/247 |
| 4,217,823 | 8/1980 | Burger | 101/248 |
| 4,231,292 | 11/1980 | Stolle | 101/247 |
| 4,309,945 | 1/1982 | Marion | 101/247 |
| 4,369,705 | 1/1983 | Gelinas | 101/247 |
| 4,375,190 | 3/1983 | Quinci et al. | 101/247 |
| 4,384,522 | 5/1983 | Ehlers et al. | 101/247 |
| 4,413,560 | 11/1983 | Rogge | 101/247 |
| 4,833,982 | 5/1989 | Liebert et al. | 101/247 |

*Primary Examiner*—Eugene H. Eickholt

*Attorney, Agent, or Firm*—Nixon & Vanderhye

[57] ABSTRACT

In the operative position shown in FIG. 4 a printing roller abuts the cylindrical surface of an impression roller to cause ink to be transferred from an anilox roller via the printing roller to the impression roller. The gear wheel on the impression roller meshes with a gear on the printing roller which in turn meshes with a gear on the anilox roller to cause rotation of those three rollers.

The printing roller and the anilox roller can be moved to the right, when viewed in FIG. 4, to move their co-operating cylindrical surfaces out of contact with each other, and yet still leave their gears in mesh in order to enable the printing roller to be changed and yet maintain the rotation of the anilox roller. A clutch is provided to enable the printing roller to be stationary when being changed, or to enable the printing roller to be correctly aligned with the impression roller when brought back into co-operation therewith.

25 Claims, 3 Drawing Sheets

PRINTING MACHINES

The present invention relates to a printing machine and to a method of operating a printing machine and it is particularly, although not exclusively applicable to machines for and methods of printing coated paper which must move continuously if the temperature of the paper or surrounding atmosphere is not to rise to such a degree that it ignites or explodes. The invention is also particularly, although not exclusively applicable to flexographic printing on substrates such as coated paper, paper, polythene and polypropylene.

BACKGROUND ART

In a known machine for printing paper an impression roller is provided with six printing rollers arranged in two sets of three rollers. Either of the sets can be brought into an operative position to cooperate with paper passing around the impression roller. However, each set can only be moved towards or away from an operative position whilst the impression roller is stationary. Consequently considerable time is wasted when changing over from printing with one set to printing with another set.

DISCLOSURE OF INVENTION

According to one aspect of the present invention, a printing machine includes a rotatable impression roller and a printing roller, the printing roller being movable between an operative position in which. In use, the printing roller rotates and prints on a sheet of material extending at least part of the way around the impression roller and an inoperative position in which, in use, the printing roller is stationary and does not print on a sheet of material extending at least partly around the impression roller, the printing roller being capable of moving between the operative and inoperative positions whilst the impression roller is rotating. With such a machine it is possible to move a printing roller between an operative and an inoperative position whilst the impression roller is rotating thereby saving a considerable amount of time. This feature also enables a printing roller to be moved whilst coated paper is passing around the impression roller thereby avoiding the need to finish a run of such paper before moving the printing roller if the risk of ignition or explosion is to be avoided.

The printing roller may be movable from the operative to the inoperative position whilst the impression roller is rotating. Alternatively or additionally the printing roller may be movable from the inoperative to the operative position whilst the impression roller is rotating.

The printing roller may be capable of being replaced by an alternative printing roller when the printing roller is in the inoperative position and the impression roller is rotating.

The printing roller may be arranged to be rotated, in the operative position, by primary drive means which are arranged to drive the impression roller. The printing roller may be arranged to be driven by the primary drive means as the printing roller moves away from or towards the operative position. A first clutch may be included between the printing roller and the primary drive means. The first clutch may allow the angular orientation of the printing roller to be set to the required relationship with the impression roller prior to the printing roller being moved to the operative position. In the inoperative position the printing roller may be disconnected from the primary drive means.

Secondary drive means may be arranged to be capable of causing rotation of the printing roller or an anilox roller associated therewith in the inoperative position. A second clutch may be included between the printing cylinder or anilox roller and the secondary drive means. The secondary drive means may be arranged to cause rotation of the printing roller via the anilox roller. The printing roller may be capable of moving relative to the anilox roller in a direction away from or towards each other.

The printing roller may be removable from the machine when in the inoperative position and when the impression roller is rotating, and the printing roller may be replaceable when the printing roller is in the inoperative position and the impression roller is rotating.

The printing roller may be capable of being driven by the primary drive means or, alternatively or additionally, by the secondary drive means from either side of the impression roller and the printing roller may be reversible.

A plurality of printing rollers may be capable of moving between an operative and an inoperative position with the impression roller when the impression roller is rotating. One or more of the printing rollers may be arranged to be driven by the primary drive means through a different clutch to another printing roller or other printing rollers also arranged to be driven by the primary drive means.

According to another aspect of the present invention a method of operating a printing machine including a rotating impression roller and a printing roller comprises moving the printing roller between an operative position in which the printing roller rotates and prints on a web of material passing at least partly around the impression roller and an inoperative position in which the printing roller does not rotate or print on the sheet of material whilst the impression roller is rotating.

The method may comprise moving the printing roller from the operative to the inoperative position whilst the impression roller is rotating or, alternatively or additionally, moving the printing roller from the inoperative to the operative position whilst the impression roller is rotating.

The method may comprise replacing a printing roller, when in the inoperative position, whilst the impression roller is rotating.

The method may comprise rotating the printing roller by primary drive means which also cause rotation of the impression roller, when the printing roller is in the operative position. The method may further comprise rotating the printing roller by the primary drive means as the printing roller moves away from or towards the operative position. The method may comprise using a clutch located between the primary drive means and the printing roller when the printing roller is located away from the operative position either to impart the drive from the primary drive means to the printing roller prior to moving the printing roller to the operative position or to release the drive from the primary drive means to the printing roller when the printing roller has been moved away from the operative position. The method may comprise using the clutch to align the peripheral moving surfaces of the impression roller and the printing roller prior to moving the printing roller to the operative position.

The method may comprise using secondary drive means to cause rotation of the printing roller or an associated anilox roller in the inoperative position. The method may further comprise using a second clutch between the secondary drive means and the printing roller or anilox roller either on commencement of rotation of the printing roller by the secondary drive means or on cessation thereof. The method may comprise causing rotation of the printing roller via the associated anilox roller located between the secondary drive means and the printing roller. The printing roller may be moved relative to the anilox roller in a direction away from or towards the anilox roller.

The method may comprise removing the printing roller from the machine when the printing roller is in the inoperative position and the impression roller is rotating and the method may further comprise replacing the printing roller when the impression roller is rotating.

The method may comprise causing rotation of the printing roller with primary or secondary driving means which may act on either side of the printing roller in dependence upon the orientation or location of the printing roller relative to the impression roller.

The method may comprise moving a plurality of printing rollers between an operative and an inoperative position. The method may further comprise causing rotation of one or more printing rollers by the primary drive means through a different clutch to another printing roller or other printing rollers also arranged to be driven by the primary drive means.

The method may comprise the printing roller printing on a web of material comprising a substrate such as coated paper, paper, polythene or polypropylene when the printing roller is in the operative position.

The present invention includes any combination of the herein described features of the machine or method.

The invention may be carried into practice in various ways, but one embodiment will now be described by way of example and with reference to the accompanying drawings, in which:

DETAILED DESCRIPTION OF DRAWINGS

Figure 1:
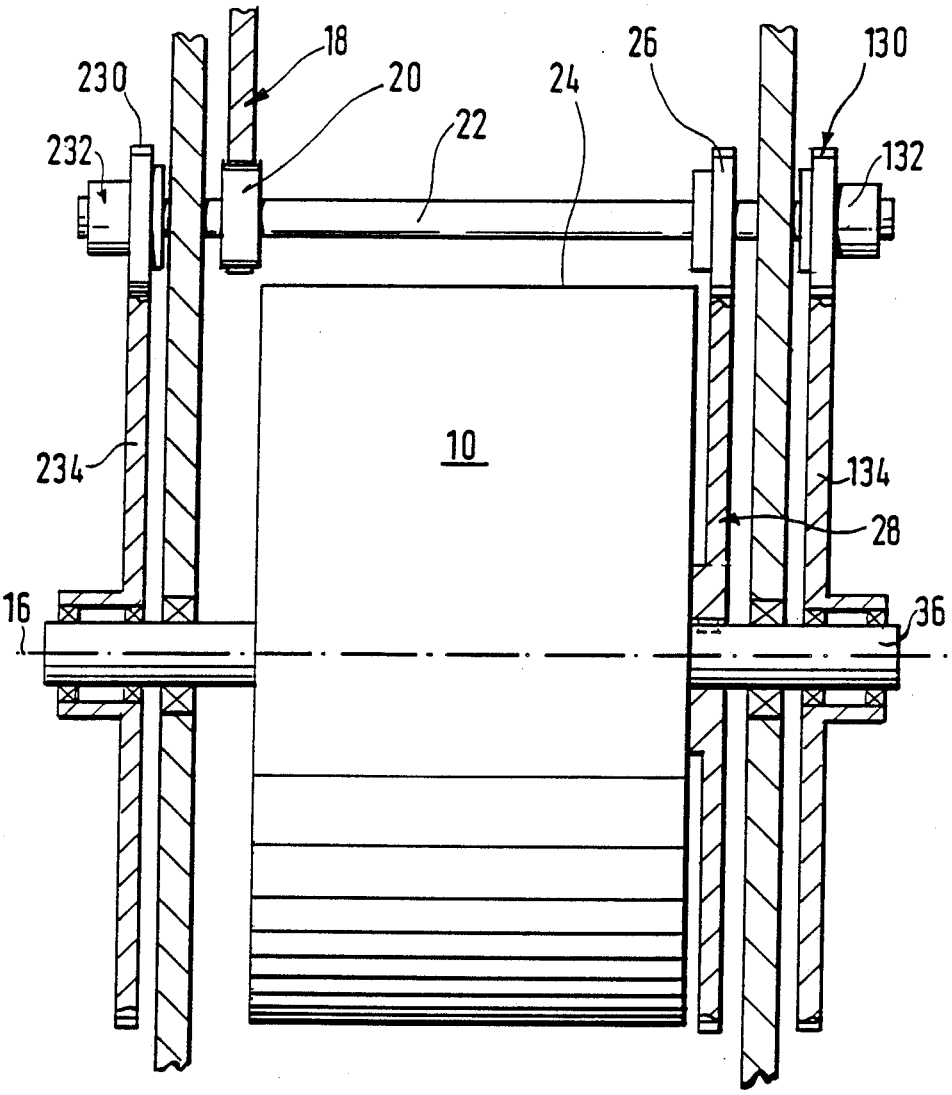
FIG. 1 is a schematic cross sectional view of an impression roller 10 and its associated drive.

The impression roller 10 shown in FIG. 1 is arranged to be rotated about an axis 16 by an input gear 18 which meshes with a primary gear 20 mounted on a shaft 22 extending parallel to the axis 16. The shaft 22 extends across the cylindrical surface 24 of the impression roller, and a gear pinion 26 on the shaft 22 meshes with a large bull gear 28 secured to the impression roller 10. Thus rotation of the input gear 18 causes rotation of the impression roller.

At either end of the shaft 22 are mounted respective station drive pinion gears 130 and 230 via associated clutches 132 and 232. The gears 130 and 230 mesh with associated gear wheels 134 and 234 which are freely rotatable about the shaft 36 of the impression roller.

In the operative position, the printing roller 138 of the station 112 is located closely adjacent to the cylindrical surface 24 of the impression roller in order to abut a sheet of coated paper passing between those rollers. The impression roller rotates, as previously described, and the gear wheel 134 meshes with a gear 140 on the end of the printing roller 138 to rotate that roller. The gear 140 meshes with a gear 142 to cause rotation of an anilox roller 144 which bears against the printing roller to transfer ink thereon. Accordingly the printing roller prints on a sheet of paper moving past that roller.

Figure 4:
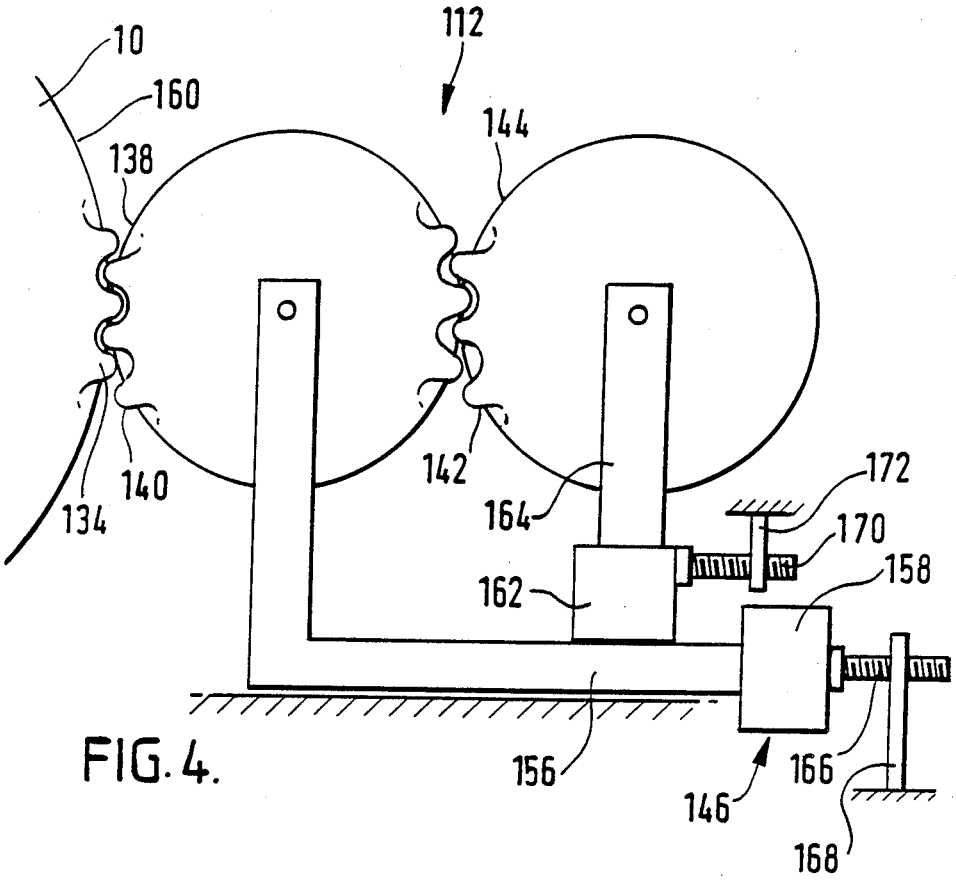
FIG. 4 is a schematic side view illustrating the cooperation between gears at a printing station and the mechanism for causing relative movement of those gears and associated rollers.

As shown schematically in FIG. 4 in order to move the printing station 112 away from the operative position to the inoperative position, a radial control 146 is operated to move at the same time the rollers 138 and 144, and their associated gears 140 and 142, away from the impression roller. This initial movement, which may be of the order of 2 mm, is achieved rapidly by moving a slide 156 to the right, as viewed in FIG. 4, into a housing 158. Thus the teeth of the gear 140 are still in mesh with, or in register with the teeth of the gear 134, but the printing roller 138 no longer contacts the web 160 of material on the impression roller 10. The anilox roller 144 is carried on the slide 156 via a housing 162 and a support 164 and accordingly moves with the slide 156 during the initial rapid movement. Once the surface of the printing roller is no longer printing on the coated paper, but before the teeth of the gear wheel 134 and the gear 140 are disengaged, the clutch 132 (shown in FIG. 1) is operated to allow the rotation of those gear wheels to cease. At the same time the anilox roller 144 is moved away from the printing cylinder, for instance of the order of 2 mm, by moving the support 164 to the right into the housing 162 such that the gears 140 and 142 still mesh but the rollers 138 and 144 no longer contact. A clutch (not shown) then allows a drive gear 148 shown in FIG. 2 from a hydraulic motor 150 to rotate the anilox roller 144 via a driven gear 152 on the anilox roller, and a ratchet (not shown) prevents the rotation of the anilox roller being imparted to its associated gear 142.

Figure 3:
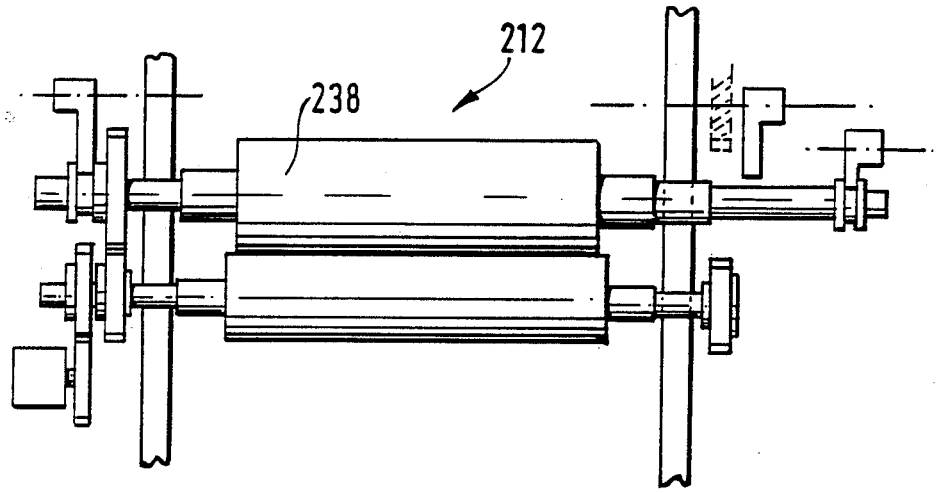
FIG. 3 is a schematic view of a second printing station 212.

The printing roller and anilox roller can then be moved further away from the impression roller. This movement is achieved by rotating a threaded shaft 166 which extends through a threaded opening in a fixed plate 168 to pull the housing 158 and the slide 156 to the right, as seen in FIG. 4. At the same time, or subsequently, the gear 142 on the anilox roller can be disengaged from the gear 140 on the printing roller by rotating a threaded shaft 170 extending through a threaded opening in a plate 172 secured to the slide 156 to cause the housing 162 and the support 164 to be moved to the right when viewed in FIG. 4. The rotation of the threaded shafts 166 and 170 can be effected manually or automatically. The printing roller can then be replaced, if desired, by a roller having a different pattern. Alternatively the printing roller could be reversed such that the gear 140 is located adjacent to a gear 154 corresponding in function to that of the gear 142. In that orientation, in the operative position, the printing roller is driven by the gear wheel 234. That orientation is shown in FIG. 3 in relation to the position of the printing roller 238.

If it is not desired to reorientate or change the printing roller in the inoperative position, the teeth of the gears 134, 140 and 142 can be left in co-operation with each other, but with the printing roller spaced from the impression roller and with the anilox roller spaced from the printing roller.

In order to return the printing station to the operative position, the anilox roller and the printing roller are brought towards each other, and the printing roller is brought towards the impression roller such that the gears 134, 140 and 142 mesh. The anilox roller is then brought into contact with the printing roller by moving the support 164 to the left with respect to the housing 162 and the drive from the hydraulic motor is isolated from the anilox roller. That movement is achieved by rotation of the shafts 166 and 170 in the opposite direction to that previously described to cause the housings 158 and 162 to be moved to the left, when viewed in FIG. 4.

The clutch 132 is then released in order that the shaft 22 drives the gears 130, 134, 140 and 142. The clutch is controlled in order that the pattern on the rotating printing cylinder 138 is moving in the correct relationship with regard to the coated paper travelling around the impression roller before the printing roller is moved towards the impression roller by moving the slide to the left in the direction away from the housing 158 to cause the printing roller to print on the coated paper.

The relative movement between the slide 156 and the support 164 and their respective housings 158 and 162 may be achieved by double acting hydraulic cylinders.

Figure 2:
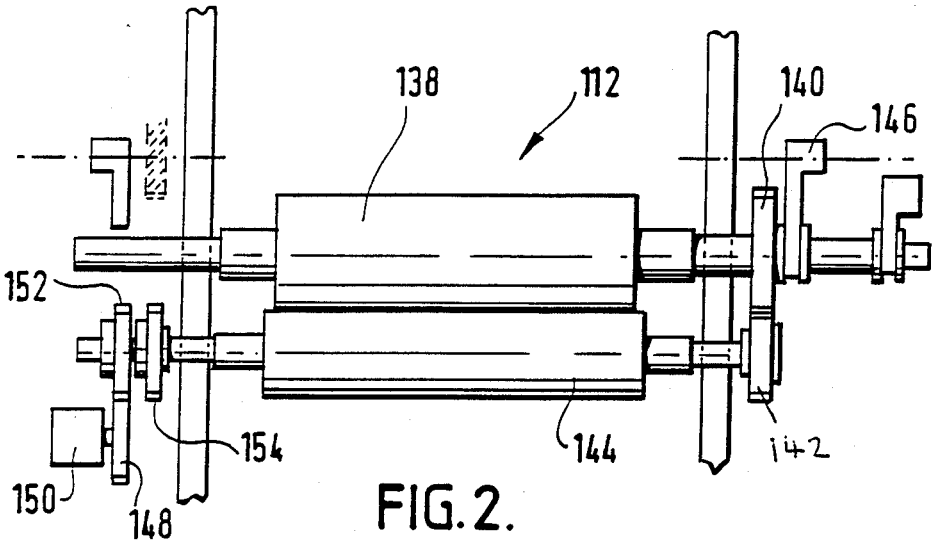
FIG. 2 is a schematic view of a first printing station 112.

The operation of the printing station 212 shown in FIG. 3 is the same as that described for the station shown in FIG. 2 with the exception that the drive for the printing roller 238 is taken from the gear 234.

Figure 5:
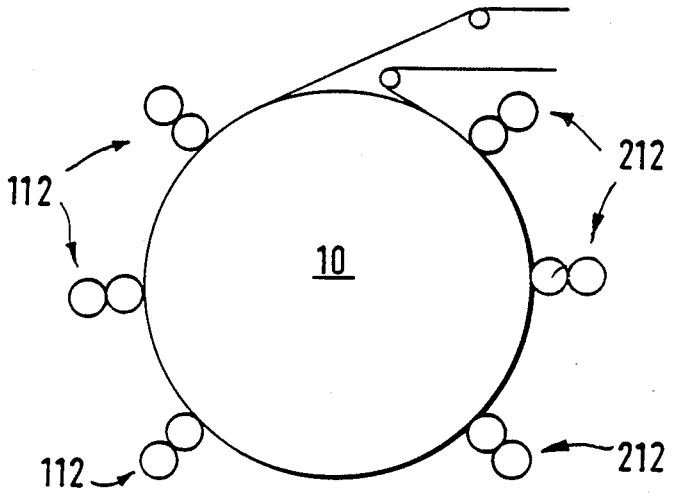
FIG. 5 is a schematic side view of an impression roller showing the orientation of six printing stations.

In use, as shown in FIG. 5, there will be six printing stations with three of the printing rollers from the stations 112 being arranged to take their drive from one wheel gear and the other three printing stations 212 being arranged to take their drive from the other gear wheel. If desired only one or some of the printing stations associated with a particular gear wheel 134 or 234 may have their gear 140 or 240 in mesh with the gear wheel 134 or 234.

Alternatively or additionally there may be more or less than three printing stations having their printing rollers associated with a particular drive gear 134 or 234. For instance, five printing rollers may be associated with one drive gear with only a single printing roller being associated with the other drive gear.

In a further embodiment, eight printing rollers may be associated with the impression roller with four printing rollers being arranged to be capable of being driven by each of the drive gears. In this further embodiment five or six printing rollers, for example, may be arranged to be capable of being driven by one drive gear with three to two printing rollers being capable of being driven by the other drive gear.

In a alternative embodiment there may be more than two drive gears with different printing station or stations being associated with each drive year whereby any of three or more different stations may be separately moved between the operative and inoperative positions.

What we claim is:

1. A method of operating a printing machine including an impression roller, a plurality of printing rollers, primary drive means and a plurality of clutches, the method comprising:

moving said printing rollers between an operative position and an inoperative position whilst said impression roller is rotating, in which:

in said operative position said printing rollers rotate and print on a web of material extending at least partly around said impression roller and, in said inoperative position, said printing rollers do not rotate or print on a sheet of material, said primary drive means causing rotation of said impression roller and rotation of at least one of said printing rollers, when in said operative position, via a selected clutch to cause said primary drive means to act on either side of said printing roller in dependence upon the orientation or location of said printing roller relative to said impression roller.

2. A method of operating a printing machine including an impression roller, a plurality of printing rollers, a first and second drive member, said first drive member being associated with a plurality of first printing rollers and said second drive member being associated with a plurality of second printing rollers, and means for moving said first and second printing rollers between an operative and an inoperative position, the method comprising, whilst said impression roller remains rotating, maintaining at least some of the first printing rollers in the operative position in which each of those printing rollers is driven by the first drive member with said driven printing rollers rotating and printing on a sheet of material extending at least part of the way around said impression roller whilst maintaining said second printing rollers in said inoperative position in which said second printing rollers do not print on said sheet of material extending at least part of the way around said impression roller and exchanging at least one of said second printing rollers whilst stationary and bringing said exchanged printing roller back into driving relationship with said second drive member whilst said second drive member is stationary, and moving at least some of said second printing rollers to an operative position in which each of those printing rollers is driven by said second drive member with said driving printing rollers rotating and printing on said sheet of material extending at least part of the way around said impression roller, and moving said first printing rollers in the operative position to said inoperative position in which said second set of printing rollers do not print on said sheet of material extending at least part of the way around said impression roller.

3. A method according to claim 2 in which the machine includes primary drive means, the method comprising driving said impression roller with said primary drive means and also driving said first and second drive members with said primary drive means when said members rotate.

4. A method according to claim 3 including a first and a second clutch, said first and second clutches being used selectively to cause said drive of said primary drive means respectively to rotate said first and second drive members.

5. A method according to claim 2 in which the machine includes secondary drive means, the method comprising rotating at least one of said printing rollers with said secondary drive means when said printing roller is in said inoperative position.

6. A method according to claim 5 in which the machine includes an anilox roller, said anilox roller being associated with one of said printing rollers, the method comprising rotating said anilox roller with said secondary drive means when said printing roller is in said inoperative position.

7. A method according to claim 5 in which the machine includes a second clutch, the method comprising using said second clutch selectively to apply said secondary drive means to said anilox roller.

8. A method according to claim 6 in which rotation of said anilox roller with said second drive means causes said printing roller to be rotated.

9. A method according to claim 6 comprising causing relative movement between said printing roller and said anilox roller towards or away from each other.

10. A method according to claim 2 comprising selecting a printing roller to be driven by said first or second drive member.

11. A method according to claim 10 comprising reversing said printing roller such that it is driven either by said first or second drive member.

12. A method according to claim 10 comprising driving said printing roller selectively either with said first drive member located on one side of said impression roller or with said second drive member located on the other side of said impression roller.

13. A printing machine including an impression roller, a plurality of printing rollers, a first and a second drive member, said first drive member being associated with a plurality of first printing rollers and said second drive member being associated with a plurality of second printing rollers, and means for moving said first and second printing rollers between an operative and an inoperative position, in which, those of said first printing rollers in the operative position, in use, are each driven by said first drive member which rotates, and said driven printing rollers rotate and print on a sheet or material extending at least a part of the way around said impression roller, and in which, in an inoperative position, at least one of said first printing rollers is capable of being stationary, said first printing rollers do not print on said sheet of material, and said first drive member is capable of being stationary; and those of said second printing rollers in the operative position, in use, are each driven by said second drive member which rotates, and said driven printing rollers rotate and print on a sheet of material extending at least part of the way around said impression roller, and in which, in said inoperative position, at least one of said second printing rollers is capable of being stationary, said second printing rollers do not print on said sheet of material, and said second drive member is capable of being stationary, said first and second printing rollers being movable from the inoperative position to the operative position whilst said impression roller is rotating.

14. A printing machine according to claim 13, in which at least one of said first printing rollers is arranged to be replaced when said printing roller is in the inoperative position and said impression roller is rotating.

15. A printing machine according to claim 13, in which at least one of said second printing rollers is arranged to be replaced when said printing roller is in the inoperative position and said impression roller is rotating.

16. A printing machine according to claim 13 including primary drive means, said primary drive means being arranged to drive said impression roller and said first and second drive members.

17. A printing machine according to claim 16 including a first and a second clutch located respectively between the primary drive means and the first and second drive members.

18. A printing machine according to claim 17 including secondary drive means, said secondary drive means being arranged to be capable of causing rotation of an associated printing roller when that roller is in the inoperative position.

19. A printing machine according to claim 18 including an anilox roller, said anilox roller being associated with said printing roller, said secondary drive means being arranged to be capable of causing rotation of said anilox roller.

20. A printing machine according to claim 19 including a second clutch, in which said second clutch is included between said printing roller and said secondary drive means.

21. A printing machine according to claim 19 in which said secondary drive means are arranged to cause rotation of said printing roller via said anilox roller.

22. A printing machine according to claim 19 in which said priting roller is arranged to move relative to said anilox roller in a direction away from or towards said anilox roller.

23. A printing machine according to claim 13 in which at least one of said printing rollers is arranged to be selectively driven either by said first drive member or said second drive member.

24. A printing machine according to claim 23 in which said printing roller is reversible.

25. A printing machine according to claim 13 in which said first drive member is located on one side of said impression roller and said second drive member is located on the other side of said impression roller.

* * * * *